United States Patent [19]

Röck et al.

[11] 4,089,567

[45] May 16, 1978

[54] WITHDRAWAL GUIDE FOR DRAWERS

[76] Inventors: Erich Röck, Kuferstrasse 1085, A-6973 Hochst; Bernhard Mages, Harte 10, A-6850 Dornbirn, both of Austria

[21] Appl. No.: 660,316

[22] Filed: Feb. 23, 1976

[30] Foreign Application Priority Data

| | | |
|---|---|---|
| Feb. 25, 1975 | Austria | 1447/75 |
| Jun. 6, 1975 | Austria | 4340/75 |

[51] Int. Cl.[2] ..... F16C 29/02

[52] U.S. Cl. ..... 308/3.6; 312/341 R; 312/349

[58] Field of Search ..... 308/3 R, 3 A, 3 CH, 308/3.6, 3.8; 312/341 R, 349, 350

[56] References Cited

U.S. PATENT DOCUMENTS

| | | | |
|---|---|---|---|
| 2,759,773 | 8/1956 | Wilmer et al. | 308/3.6 |
| 3,701,577 | 10/1972 | Fischer | 308/3.6 |
| 3,897,981 | 8/1975 | Kaplan | 308/3.6 |
| 3,911,835 | 10/1975 | Schill | 308/3.6 |

*Primary Examiner*—Richard A. Bertsch

*Attorney, Agent, or Firm*—Haseltine, Lake & Waters

[57] ABSTRACT

A withdrawal guide for drawers or the like, where the drawer has two external sides, for use in a fixed structure, the latter having two internal sides, includes two support rails disposed on each of the fixed structure sides, respectively, two guide rails disposed on the external sides of the drawer, respectively, and two mobile units. Each mobile unit includes at least two rollers; each of the rollers are supported between a corresponding guide and support rail for taking up vertical forces. Each support rail has a movable track, and each movable track has a withdrawal stop for the mobile unit, and is formed with a cut-out. Each mobile unit is formed with at least one controllable stop, and the stop may be engaged with the cut-out in the movable track, when the drawer is pulled out from the fixed structure for securing the mobile unit in the inward-movable direction of the withdrawal guide. The support rail has a frontal zone, and either the support-rail frontal zone or the mobile unit includes a safeguard against tilting of the mobile unit.

7 Claims, 12 Drawing Figures

WITHDRAWAL GUIDE FOR DRAWERS

BACKGROUND OF THE INVENTION

The invention relates to a guide for the withdrawal of drawers or the like with one support rail at each side on the fixed structure and one withdrawal or guide rail at each side on the drawer or container, and at least two rollers in a roller carrier in the form of a mobile unit at each side between the withdrawal rail and the support rail taking the vertical forces.

Withdrawal guides of this kind find are used for drawers but also for working surfaces in modern furniture construction, and in particular in many ways in the construction of kitchen furniture.

The general object of the invention is to simplify the pulling out of drawers and make them as jam-free as possible.

Known drawer guides are, as has been stated, generally equipped with rollers, but also with slides, preferably in plastic, or with a combination of rollers and slides, but also with freely mobile ball races.

OBJECT OF THE INVENTION

It is the object of the present invention to produce a withdrawal guide of the kind initially mentioned which makes possible a particularly frictionless sliding of the supporting rail of the fixed structure, and of the guide rail on the load-carrying side, and which moreover yields significant material economies in its manufacture compared to known withdrawal guides.

SUMMARY OF THE INVENTION

In the case of a withdrawal guide of this kind the drawer with the guide rails may also be withdrawn as a whole from the support rails on the piece of furniture and pushed back in again effortlessly.

Smoother operation and better loading capacity are also attained by means of the embodiments illustrated in accordance with the invention.

This is attained in accordance with the present invention by each support rail having a pull-out detent for the mobile unit and the mobile unit being provided with at least one controllable stop which, when the drawer is pulled out, engages in a locking member e.g. a cut-out of the movable face of the support rail, and secures the mobile unit in the inward direction of the withdrawal guide, by the support rail having a tipping latch in the frontal zone for the mobile unit by the mobile unit being provided with such a device.

Advantageously the stop may be a peg, and the cut-out may take the form of a punched hole.

A further embodiment example is characterised by a means of pressurisation on the mobile unit opposite to the stop, which corresponds to an abutment of the support rail known per se.

The means of pressurisation is advantageously constituted as a spring flap.

The pressurisation means can thus be produced in one piece with the mobile unit, and is made preferably of injection-moulded plastic.

Another embodiment example of the invention provides for the stop being preferably in the form of a spring-loaded slide, which is located by a vertical guide on the mobile unit and has an abutment for the track of the guide rail; in the free position the slide is advantageously secured by means of a hook behind a protrusion on the mobile unit.

In one example of an embodiment which has proved particularly good in practice, the stop is made in the form of a catch carried rotatably on a spindle, when the catch is advantageously an injection moulding in plastic, and has a spring-loading flap which is supported on the mobile unit.

In order to obtain a large loading capacity for the mobile unit, in a further preferred form of embodiment provision is made to support the rollers on their running surface in the mobile unit. This is of great significance, especially in the case of plastic rollers, since constituting a support on the hub leads to a reduction of the loading capacity.

In order to simplify a smooth engagement of the peg or stop when the drawer is pulled out, at least one of the supporting rollers, and in this in particular instance the rearward supporting roller located in the vicinity of the stop, may be carried in the mobile unit with a vertical clearance.

BRIEF DESCRIPTION OF THE DRAWINGS

The present invention will be better understood from the accompanying drawings in which.

DESCRIPTION OF THE SPECIFIC EMBODIMENTS

Figure 1:
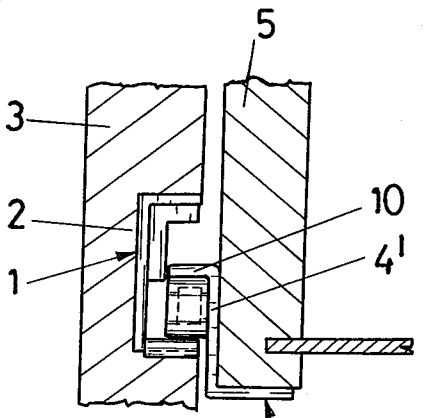
FIG. 1 shows a front view of a withdrawal guide in accordance with the present invention.

The withdrawal guide in accordance with the present invention consists of a support rail 1 on a fixed structure, which can for example be a U-section, and which is inserted into a groove 2 of the structure side wall 3, and also of a guide rail 4 of the drawer.

In the embodiment examples the guide rail 4 on the drawer is given a Z-shaped profile or cross section, so that it engages a lower portion of a side-wall 5 of a drawer.

Obviously the guide rail 4 may also have an L-shaped profile.

As can be seen from the drawing, a mobile unit 6, which serves as a support for the rollers, is disposed in the U-section of the support rail 1. The mobile unit 6 is advantageously a plastic injection moulding. In the embodiment examples the rollers 7 are carried in a triangular arrangement in the mobile unit, in such way that rollers 7 are running on the supporting track 8 of the support rail 1 at two points, while the third roller 7 or the third group of rollers 7 is located in a zone of the upper horizontal track 9 of the support rail 1.

When the drawer is closed the mobile track 10 of the guide rail 4 is pushed into the mobile unit 6 in such a way that the mobile track 10 is bearing upon the two lower rollers 7 or groups of rollers, while the third and center roller 7 or group of rollers centered relative to the depth of a fixed structure or piece of furniture is or are supported above the mobile or running track 10.

By means of this arrangement the guide rail 4 and together therewith the drawer 5 is held in the support rail 1 secure against tipping.

If the drawer 5 and together therewith the guide rail 4 is pulled out in the direction of the arrow A from a piece of furniture 3, then the free mobile unit 6 moves together therewith.

In the case of the the first embodiment of the invention, shown in FIG. 2, in the forward zone the flaps 11, injection-moulded in one piece with the mobile unit 6, will then become located below an abutment 12 of the support rail 1.

The abutment 12 is disposed on the free edge of the upper horizontal track 9 of the support rail 1, and at the same time forms a lateral safeguard against tipping for the mobile unit 6 when the drawer has been pulled out.

The abutment 12 serves to prevent the mobile unit 6 from being pulled completely out of the support rail 1, and also prevents the unit tipping over when the drawer is pulled right out.

The mobile unit 6, in accordance with the invention, differs in one respect from the usual center rails of known different withdrawal assemblies in that it in itself transmits no forces, and as already mentioned, acts only as a roller cage for the rollers 7, and it is consequently advantageous if it remains wholly within the support rail 1, even when the drawer 5 is pulled out completely.

Figure 2:
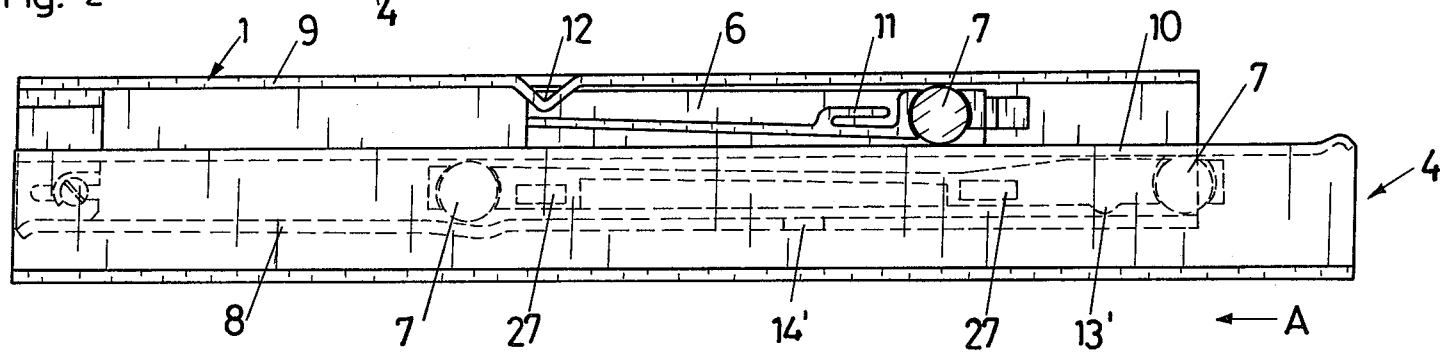
FIG. 2 shows an elevational view of a first embodiment of the invention in part cross-section.

If in the case of the first embodiment example as shown in FIG. 2, the drawer is pulled out completely, the flap 11 of the mobile unit 6 presses downwards and together with it the peg 13' acts as a stop into the cut-out 14' of the support track 8. This holds the mobile unit 6 on position in the support rail 1, and because of the abutment 12 it cannot fall out, even when the lateral guidance of the drawer is lacking.

It has to be particularly emphasised that the mobile unit 6 is not only secured in the direction of withdrawal, effected in the embodiment example already by the abutment 12, but it is secured in the direction of insertion. It thus remains in the vicinity of the safeguard against tilting, which in this case is formed by the abutment 12.

In the case of the second embodiment example, as shown in FIGS. 3, 5, 6, 9 and 11, if the guide rail 4 is pulled further out, and thus taken out of the mobile unit 6, then the running or mobile track 10 is also pulled forward and out from under the slide abutment 15 of the slide 16.

Figure 5:
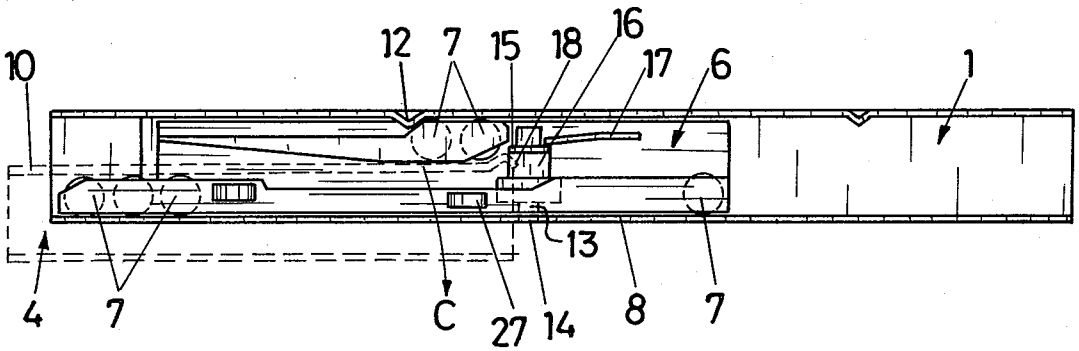
FIG. 5 corresponds to FIG. 3, but with the guide rail advanced with respect to FIG. 3.

The slide 16, which constitutes the stop for the mobile unit 6, can now be pressed into the cut-out 14 of the support track 8 of the support rail 1 by the spring 17, or by the end of the support track 10, if the guide rail is slightly tilted in the direction if the arrow C (FIG. 5).

Figure 3:
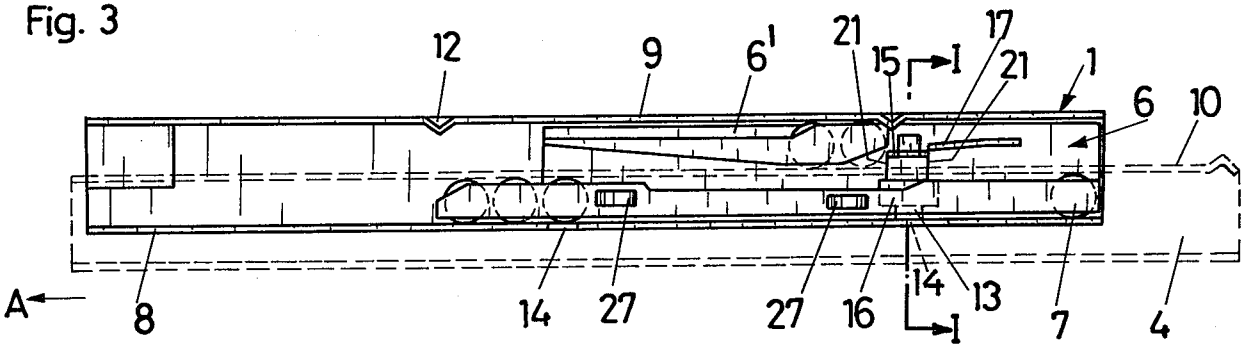
FIG. 3 shows an elevational view of a second embodiment of the present invention in part cross-section.
Figure 6:
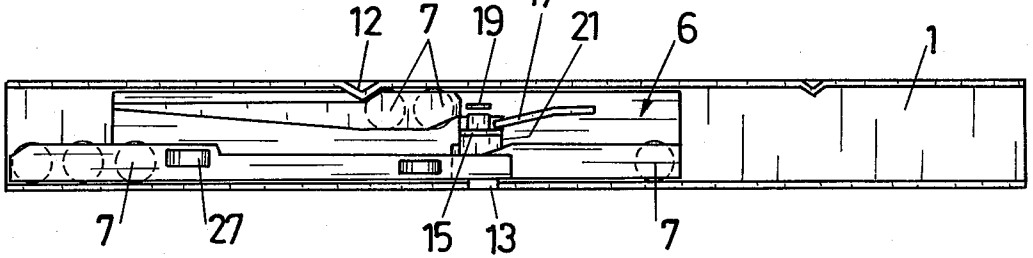
FIG. 6 corresponds to FIG. 5, but showing the slide abutment in a different position.
Figure 7:
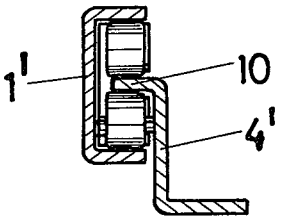
FIG. 7 shows a view in the direction of arrow A of FIG. 2.
Figure 8:
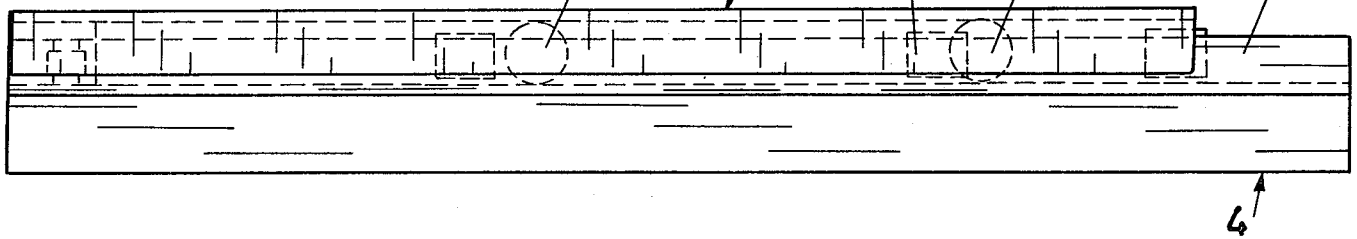
FIG. 8 shows a plan view of FIG. 1.
Figure 9:
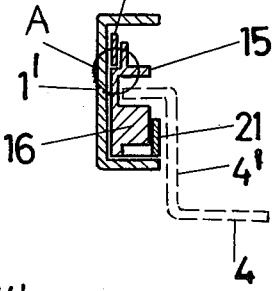
FIG. 9 shows a section along the line I—I of FIG. 3.

The mobile unit 6 is thus again secured in relation to its running direction with the guide rail 4 pulled out, remains in the position shown in FIG. 6, and is consequently secured against tipping out of the support rail 1 through the abutment 12, the wall 6' of the mobile unit 6 being pushed behind the latter, as is best seen in FIG. 3.

When the guide rail 4 is pushed into the mobile unit 6 the slide 16 is lifted by the squared end 18 of the running track 10 (through the slide abutment 15) and the mobile unit 6 is released.

To prevent constant friction of the slide abutment 15 on the running track 10 when the drawer is moved, a protrusion 19 is formed on the mobile unit 6, behind which a hook 20 engages the slide 16 in the lifted state of the mobile unit 6. The slide 16 is also guided in guides 21 of the mobile unit 6.

Figure 4:
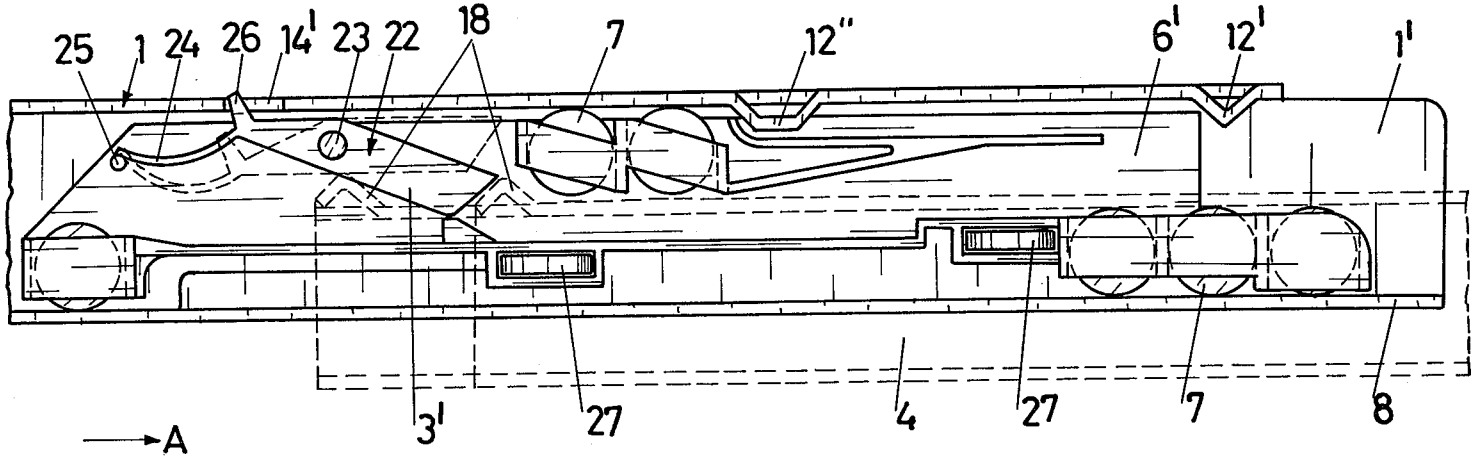
FIG. 4 shows an elevational view of a third embodiment of the present invention in part cross-section.
Figure 11:
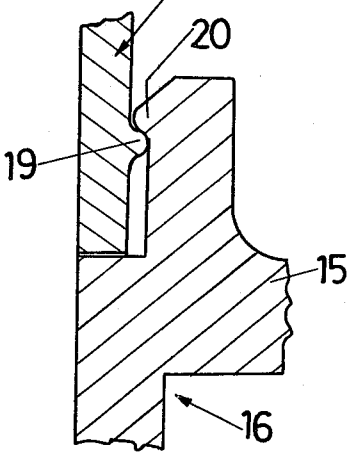
FIG. 11 shows an enlargement of sector A of FIG. 9.
Figure 10:
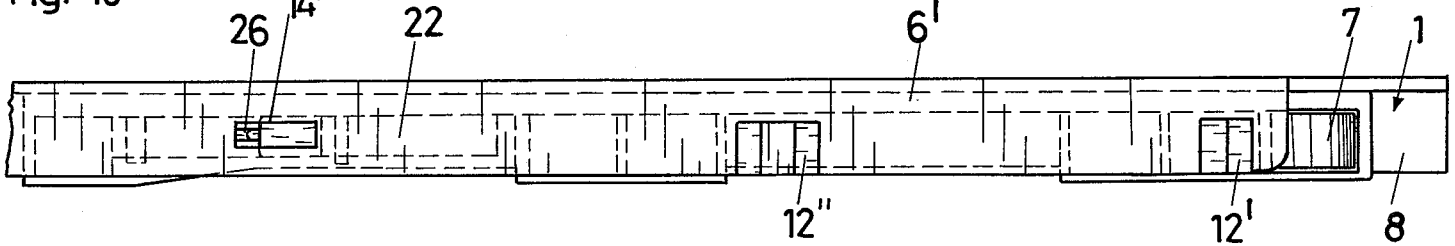
FIG. 10 shows a plan view of FIG. 4.
Figure 12:
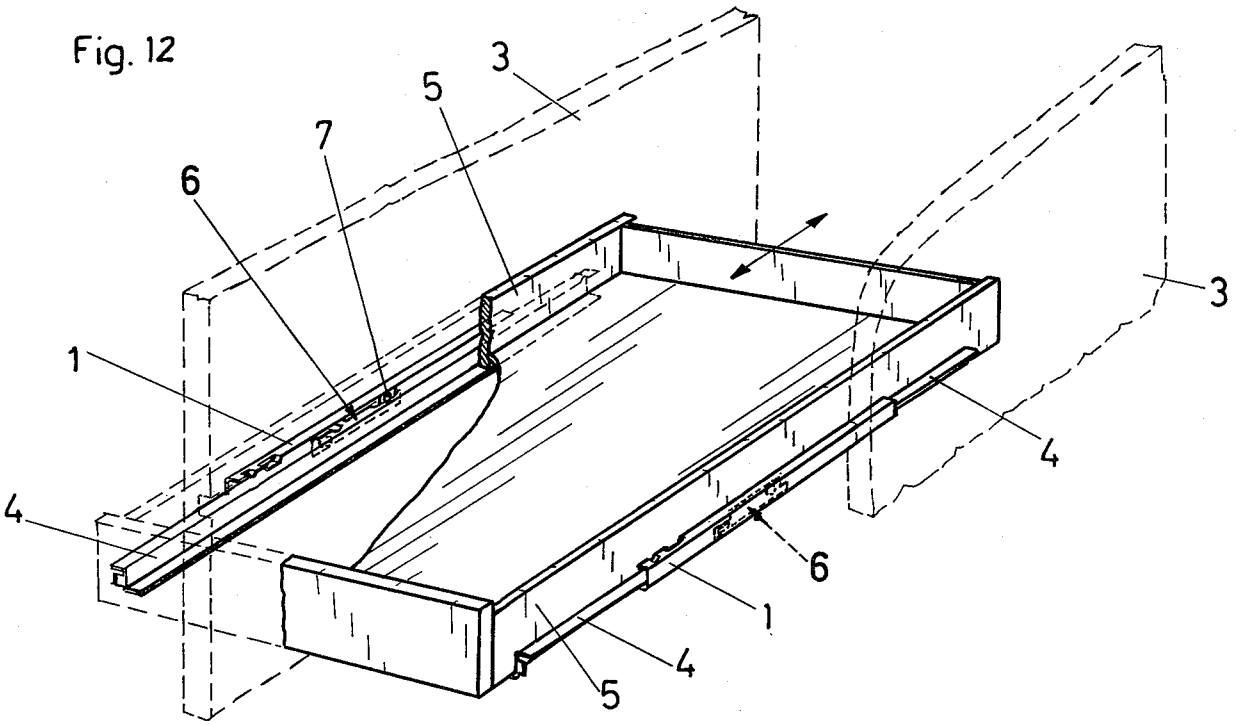
FIG. 12 shows a partial perspective view of FIG. 3.

In the case of the third form of embodiment shown in FIGS. 4 and 10, the securing of the mobile unit 6 is effected by a latch 22. The latch 22 is carried on a spindle 23 on the mobile unit 6, and has a spring part 24 which bears against a lug 25 on the mobile unit 6.

Latch 22 and spring part 24 are preferably plastic injection mouldings. The latch 22 is provided with a peg 26 at one end, which in the locking position enters into a cut-out 14' in the upper horizontal track 9 of the support rail 1 (FIG. 4, latch shown completely).

Thus the mobile unit 6 is bolted in the same way as in the other embodiment examples and secured against movement. The safeguard against tilt for the mobile unit 6 is constituted on the one hand by the abutments 12' and 12'' behind which the wall 6' of the mobile unit 6 is pushed, and on the other by the peg 26 itself.

If the guide rail 4 is pushed into the mobile unit 6, it lifts with its squared end 18 the other end of the latch 22, constituted as an abutment 3'. In order to simplify the pushing in, the guide rail 4 is tipped under the latch 22 when pushed in.

When the drawer 5 is pushed in, the latch 22 is held in the position shown in broken line in FIG. 4. The mobile unit 6 can thus be pushed freely.

In the form of the embodiment shown, and in order to obtain ease of running i.e. lateral aligning rollers 27 are provided which rotate about an axis which is directed normally to the axes of the running rollers 7.

The aligning rollers 27 then run on the vertical track 1' of the support rail 1, and on the vertical track 4' of the withdrawal rail 4. The steadying rollers 27 can, for example, be carried in a manner known per se on normal axes in the mobile unit 6, or they are only secured against falling out by spigots, but are otherwise only retained at their periphery, however. The mobile unit, according to the invention, substantially differs from the central rails of known differential withdrawal assemblies in that it does not have any supporting function itself. The transmission of load only takes place via the rollers. Therefore it generally will be advantageous when the mobile unit remains totally or at least for the most part within the support rail, also when the support rail is pulled out.

What we claim is:

1. A withdrawal guide for drawers, the drawer having two external sides, for use in a fixed structure having two internal sides comprising:

two support rails placeable on each of the fixed structure sides, respectively;

two guide rails disposed on the external sides of the drawer, respectively;

two mobile units, normally disposed in said support rails, respectively, each of said mobile units including at least two rollers, each of said rollers being supported between a corresponding one of said guide and support rails for taking up vertical forces, each of said support rails having a track, each of said tracks being formed with a cut-out, each of said mobile units being formed with at least one controllable stop, said stop being engageable with the cut-out in the track, upon the drawer being pulled out from said fixed structure for preventing said mobile unit to move in an inward direction, each of said support rails having a frontal zone, a safeguard against tilting of said mobile unit being provided on one of the support rail frontal zone and said mobile unit.

2. A withdrawal guide according to claim 1 wherein the tilting safeguard is an abutment, said abutment projecting over said mobile unit upon said mobile unit occupying a position in the frontal zone of said support rails in an outward direction.

3. A withdrawal guide according to claim 2 wherein said abutment includes safeguard means for preventing said drawer from being pulled out from said fixed structure.

4. A withdrawal guide according to claim 1 wherein said stop is a projection on said mobile unit.

5. A withdrawal guide according to claim 1 wherein said mobile unit is formed with a plurality of recesses, said rollers being disposed in said recesses, respectively.

6. A withdrawal guide according to claim 1, wherein said mobile unit is formed with a second abutment, and wherein at least one of said guide rail is formed with a second track for normally engaging said second abutment, said stop being a spring-loaded slide.

7. A withdrawal guide according to claim 6 wherein said slide is formed with a hook, and wherein said mobile unit is formed with a protrusion for being securable to said hook.

* * * * *